US008655650B2

(12) United States Patent
Chamberlain

(10) Patent No.: US 8,655,650 B2
(45) Date of Patent: Feb. 18, 2014

(54) MULTIPLE STREAM DECODER

(75) Inventor: Mark W. Chamberlain, Honeoye Falls, NY (US)

(73) Assignee: Harris Corporation, Melbourne, FL (US)

( * ) Notice: Subject to any disclaimer, the term of this patent is extended or adjusted under 35 U.S.C. 154(b) by 1327 days.

(21) Appl. No.: 11/729,435

(22) Filed: Mar. 28, 2007

(65) Prior Publication Data

US 2008/0243489 A1 Oct. 2, 2008

(51) Int. Cl.
*G10L 19/00* (2013.01)

(52) U.S. Cl.
USPC ..... 704/219; 704/201; 704/233; 704/268

(58) Field of Classification Search
USPC ..... 704/219, 268, 233, 201
See application file for complete search history.

(56) References Cited

U.S. PATENT DOCUMENTS

| | | | | |
|---|---|---|---|---|
| 6,081,776 | A * | 6/2000 | Grabb et al. | 704/219 |
| 6,917,914 | B2 | 7/2005 | Chamberlain | |
| 2007/0094018 | A1 * | 4/2007 | Zinser et al. | 704/219 |
| 2007/0208565 | A1 * | 9/2007 | Lakaniemi et al. | 704/268 |

FOREIGN PATENT DOCUMENTS

| | | |
|---|---|---|
| FR | 2891098 | 3/2007 |
| WO | WO 2005093717 | 10/2005 |

OTHER PUBLICATIONS

Chamberlain, M. W., A 600 bps MELP vocoder for use on HF channels, 2001; Military Communications Conference, 2001. MILCOM 2001. Communication Network—Centric Operations: Creating the Information Force. IEEE; vol. 1, on pp. 447-453 vol. 1.
A. B. Touimi et al., "A summation algorithm for MPEG-1 coded audio signals: a first step towards audio processing in the compressed domain", Ann. Telecommun. 55, No. 3-4, 2000.

* cited by examiner

*Primary Examiner* — Douglas Godbold
*Assistant Examiner* — Mark Villena
(74) *Attorney, Agent, or Firm* — Harness, Dickey & Pierce, PLC

(57) ABSTRACT

A method is provided for decoding data streams in a voice communication system. The method includes: receiving two or more data streams having voice data encoded therein; decoding each data stream into a set of speech coding parameters; forming a set of combined speech coding parameters by combining the sets of decoded speech coding parameters, where speech coding parameters of a given type are combined with speech coding parameters of the same type; and inputting the set of combined speech coding parameters into a speech synthesizer.

16 Claims, 3 Drawing Sheets

Prior Art

MULTIPLE STREAM DECODER

FIELD

The present disclosure relates generally to full-duplex voice communication systems and, more particularly, to a method for decoding multiple data streams received in such system.

BACKGROUND

Secure voice operation with full-duplex collaboration is highly desirable in military radio applications. Full-duplex voice communication systems enable users to communication simultaneously. In existing radio products, full-duplex collaboration has been achieved through the use of multiple vocoders residing in each radio as shown in FIG. 1. In this example, the radio is equipped with three vocoders to support reception of voice signals from three different speakers within the system. The speech output by each vocoder is summed and output by the radio. However, each vocoder requires significant computational resources and increases the hardware requirements for each radio.

Therefore, it would be desirable to provide a more cost effective means of achieving full-duplex collaboration in a radio communication system. The statements in this section merely provide background information related to the present disclosure and may not constitute prior art.

SUMMARY

A method is provided for decoding data streams in a voice communication system. The method includes: receiving two or more data streams having voice data encoded therein; decoding each data stream into a set of speech coding parameters; forming a set of combined speech coding parameters by combining the sets of decoded speech coding parameters, where speech coding parameters of a given type are combined with speech coding parameters of the same type; and inputting the set of combined speech coding parameters into a speech synthesizer.

Further areas of applicability will become apparent from the description provided herein. It should be understood that the description and specific examples are intended for purposes of illustration only and are not intended to limit the scope of the present disclosure.

DRAWINGS

The drawings described herein are for illustration purposes only and are not intended to limit the scope of the present disclosure in any way.

DETAILED DESCRIPTION

Figure 1:
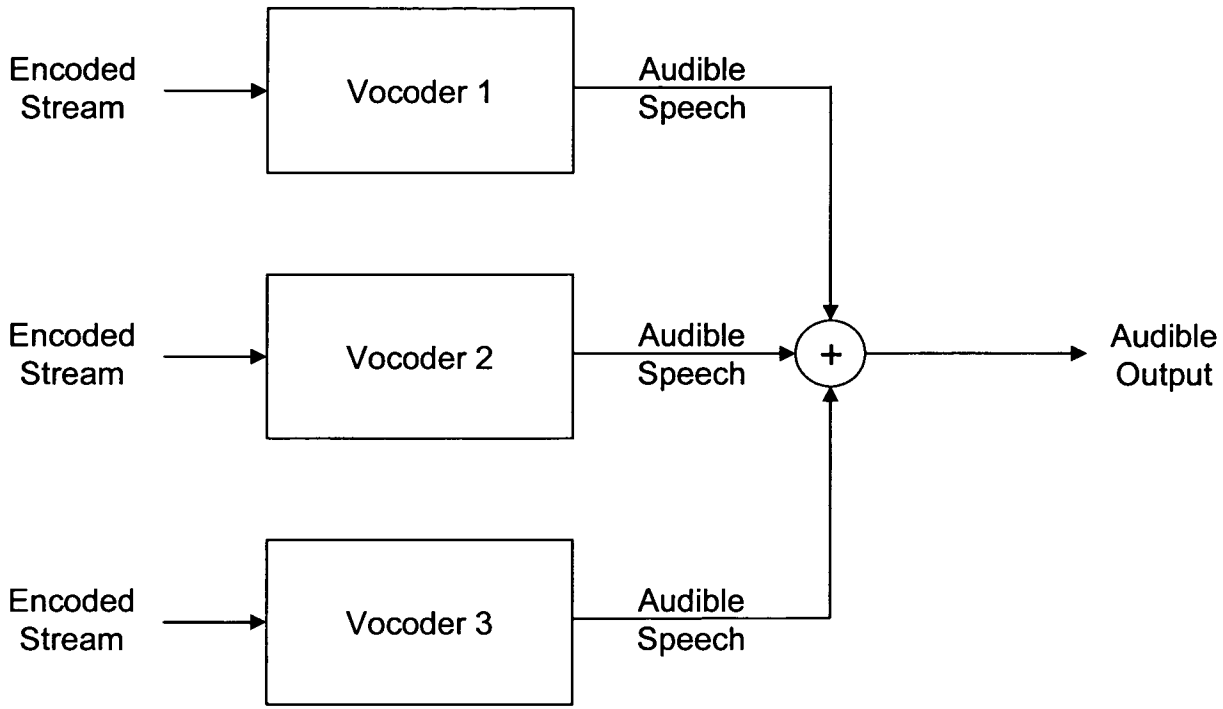
FIG. 1 is a diagram depicting the hardware configuration for an existing radio which supports full-duplex collaboration.
Figure 2:
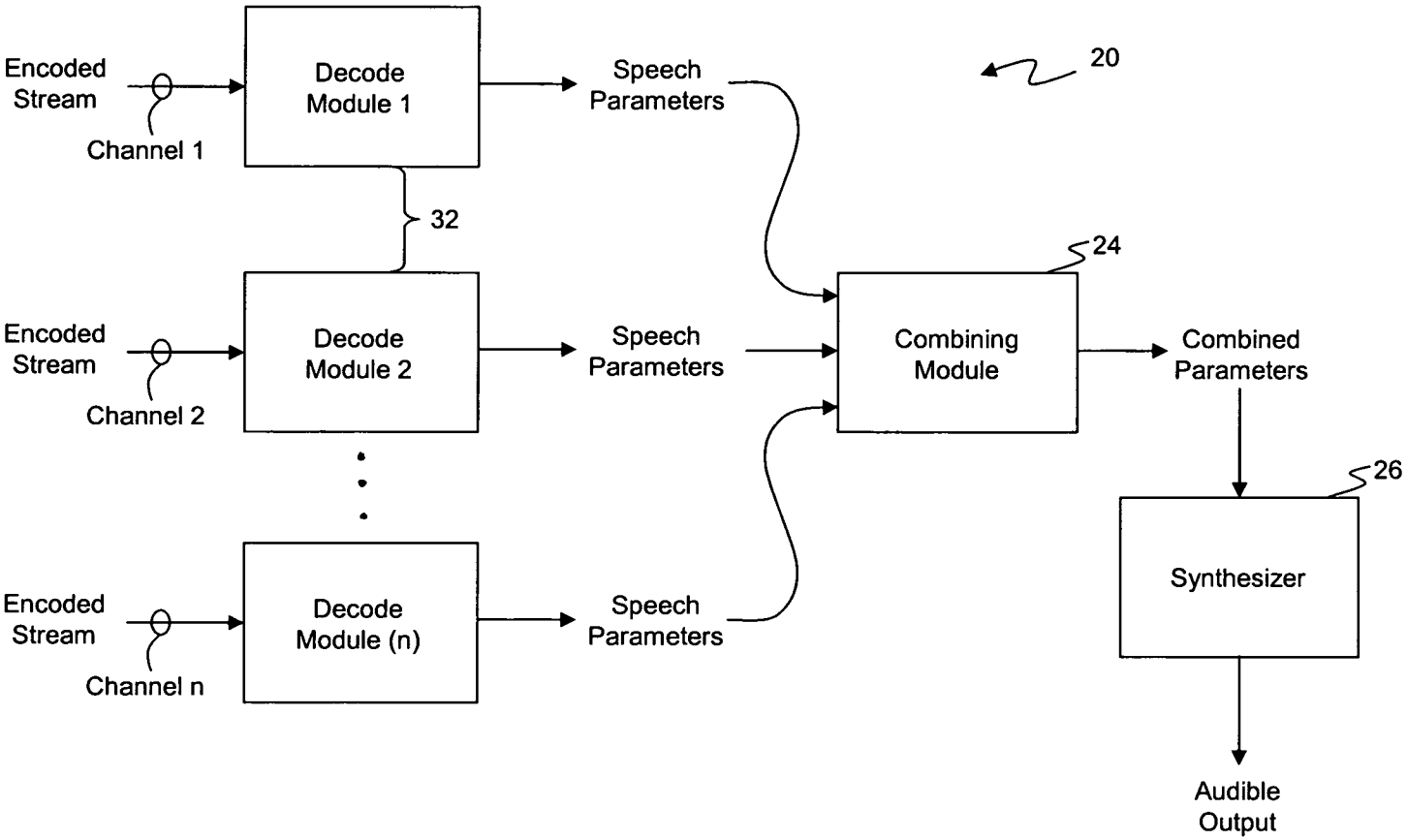
FIG. 2 is a diagram depicting an improved design for a vocoder which supports full-duplex collaboration.

FIG. 2 illustrates an improved design for a vocoder 20 which supports full-duplex collaboration. The vocoder 20 is generally comprised of a plurality of decoder modules 22, a parameter combining module 24, and a synthesizer 26. In an exemplary embodiment, the vocoder 20 is embedded in a tactical radio. Since other radio components remain unchanged, only the components of the vocoder are further described below. Exemplary tactical radios include a handheld radio or a manpack radio from the Falcon III series of radio products commercially available from Harris Corporation. However, other types of radios as well as other types of voice communication devices are also contemplated by this disclosure.

The vocoder 20 is configured to receive a plurality of data streams, where each data stream has voice data encoded therein and corresponds to a different channel in the voice communication system. Voice data is typically encoded using speech coding. Speech coding is a process for compressing speech for transmission. Mixed Excitation Linear Prediction (MELP) is an exemplary speech coding scheme used in military applications. MELP is based on the LPC10e parametric model and defined in MIL-STD-3005. While the following description is provided with reference to MELP, it is readily understood that the decoding process of this disclosure is applicable to other types of speech coding schemes, such as linear predictive coding, code-excited linear predictive coding, continuously variable slope delta modulation, etc.

To support multiple data streams, the vocoder includes a stream decoding module 22 for each expected data stream. Although the number of stream decoding modules preferably correlates to the number of expected collaborating speakers (e.g., 3 or 4), different applications may require more or less stream decoding modules. Each stream decoding module 22 is adapted to receive one of the incoming data streams and operable to decode the incoming data stream into a set of speech coding parameters. In the case of MELP, the decoded speech parameters are gain, pitch, unvoiced flag, jitter, bandpass voicing and a line spectral frequency (LSF) vector. It is readily understood that other speech coding schemes may employ the same and/or different parameters which may be decoded and combined in a similar manner as described below.

To further compress the voice data, some or all of the speech coding parameters may optionally have been vector quantized prior to transmission. Vector quantization is the process of grouping source outputs together and encoding them as a single block. The block of source values can be viewed as a vector, hence the name vector quantization. The input source vector is then compared to a set of reference vectors called a codebook. The vector that minimizes some suitable distortion measure is selected as the quantized vector. The rate reduction occurs as the result of sending the codebook index instead of the quantized reference vector over the channel. When speech coding parameters have been vector quantized, the stream decoding modules 22 will also handle the de-quantization step of the decoding process.

Decoded speech parameters from each stream decoding module 22 are then input to a parameter combining module 24. The parameter combining module 24 in turn combines the multiple sets of speech coding parameters into a single set of combined speech coding parameters, where speech coding parameters of a given type are combined with speech coding parameters of the same type. Exemplary methods for combining speech coding parameters are further below.

Lastly, the set of combined speech coding parameters are input to a speech synthesizing portion 26 of the vocoder 20. The speech synthesizer 26 converts the speech coding parameters into audible speech in a manner which is known in the art. In this way, the audible speech will include voice data from multiple speakers. Depending on the combining method, voices from multiple speakers are effectively blended together to achieve full-duplex collaboration amongst the speakers.

Figure 3:
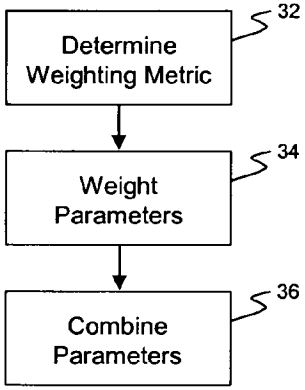
FIG. 3 is a flowchart illustrating an exemplary method for combining speech coding parameters.

An exemplary method for combining speech coding parameters is further described in relation to FIG. 3. A weighting metric is first determined at 32 for each channel over which speech coding parameters were received. It is understood that each set of speech coding parameters input to the parameter combining module was received over a different channel in the voice communication system. If a data stream is not received on a given channel, then no weighting metric is determined for this channel.

In an exemplary embodiment, the weighting metric is derived from an energy value (i.e., gain value) at which a given data stream was received at. Since the gain value is typically expressed logarithmically in decibels ranging from 10 to 77 dB, the gain value is preferably normalized and then converted to a linear value. Thus, a normalized linear gain value may be computed as NLG=power10(gain−10). For MELP, two individual gain values are transmitted for every frame period. In this case, the normalized gain values may be added, that is (gain[0]−10)+(gain[1]−10), before computing a linear gain value. The weighting metric for a given channel is then determined as follows:

$$\text{Weighting metric}_{ch(i)}=\text{NLG}_{ch(i)}/[\text{NLG}_{ch(1)}+\text{NLG}_{ch(2)}+\ldots\text{NLG}_{ch(n)}]$$

In other words, the weighting metric for a given channel is determined by dividing the normalized linear gain value for the given channel by the summation of the normalized linear gain value for each channel over which speech coding parameters were received. Rather than taking the gain value for the entire signal, it is envisioned that the weighting metric may be derived from the gain value taken at a particular dominant frequency within the signal. It is also envisioned that the weighting metric may be derived from other parameters associated with the incoming data streams.

In another exemplary embodiment, the weighting metric for a given channel is assigned a predefined value based upon the gain value associated with the given channel. For example, the channel having the largest gain value is assigned a weight of one while remaining channels are assigned a weight of zero. In another example, the channel having the largest gain value may be assigned a weight of 0.6, the channel having the second largest gain value is assigned a weight of 0.3, the channel having the third largest gain value is assigned a weight of 0.1, and the remaining channels are assigned a weight of zero. The weight assignment is performed on a frame-by-frame basis. Other similar assignment schemes are contemplated by this disclosure. Moreover, other weighting schemes, such as a perceptual weighting, are also contemplated by this disclosure.

Next, speech coding parameters are weighted at 34 using the weighting metric for the channel over which the parameters were received and combined at 36 to form a set of combined speech coding parameters. In the case of the gain and pitch parameters, the speech coding parameters may be combined as follows:

$$\text{Gain}=w(1)*\text{gain}(1)+w(2)*\text{gain}(2)+\ldots w(n)*\text{gain}(n)$$

$$\text{Pitch}=w(1)*\text{pitch}(1)+w(2)*\text{pitch}(2)+\ldots w(n)*\text{pitch}(n)$$

In other words, multiply each speech coding parameter of a given type by its corresponding weighting metric and summing the products to form a combined speech coding parameter for the given parameter type. In MELP, a combined gain value is computed for each half frame.

In the case of the unvoice flag, jitter and bandpass voice parameters, the speech coding parameters from each channel are weighted and combined in a similar matter to generate a soft decision value.

$$UV\text{Flag}_{temp}=w(1)*uv\text{flag}(1)+w(2)*uv\text{flag}(2)+\ldots w(n)*uv\text{flag}(n)$$

$$\text{Jitter}_{temp}=w(1)*\text{jitter}(1)+w(2)*\text{jitter}(2)+\ldots w(n)*\text{jitter}(n)$$

$$BPV\text{temp}=w(1)*bpv(1)+w(2)*bpv(2)+\ldots w(n)*bpv(n)$$

The soft decision value is then translated to a hard decision value which may be used as the combined speech coding parameter. For instance, if UVtemp is >0.5, the unvoice flag is set to one; otherwise, the unvoice flag is set to zero. Bandpass voice and jitter parameters may be translated in a similar manner.

In the exemplary embodiment, the LPC spectrum is represented using line spectral frequencies (LSP). To combine the LSP parameters, it is necessary to convert these parameters to the frequency domain; that is, corresponding predictor coefficients. Thus, the LSP vector from each channel is converted to predictor coefficients. The predictor coefficients from the different channels can then be summed together to get a superposition in the frequency domain. More specifically, the parameters may be weighted in the manner described above.

$$\text{Pred}(i)=w1*\text{pred}1+w2*\text{pred}2+\ldots wn*\text{pred}n,$$

where i=1 to 10 Each of the ten combined predictor coefficients is converted back to ten corresponding spectral frequency parameters to form a combined LSP vector. The combined LSP vector will then serve as the input to the speech synthesizer. While this description is provided with reference to LSP representations, it is understood that other representations, such as log area ratios or reflection coefficients, may also be employed. Moreover, the combining techniques described above are easily extended to parameters from other speech coding schemes.

The above description is merely exemplary in nature and is not intended to limit the present disclosure, application, or uses.

What is claimed is:

1. A method for decoding data streams in a voice communication system, comprising:

receiving two or more data streams having voice data encoded therein, where each data stream is received over a different channel in the voice communication system;

decoding each data stream into a set of speech coding parameters, each set of speech coding parameters having different types of parameters and parameters were derived from a parametric model of a vocal tract;

determining a weighting metric for each channel over which speech coding parameters were received, where the weighting metric is derived from an energy value at which a given data stream was received;

normalizing the weighting metric for each channel to a linear scale;

weighting speech coding parameters by the normalized weighting metric for the channel over which the speech coding parameter was received;

combining weighted speech coding parameters to form a set of combined speech coding parameters, where speech coding parameters of a given type are combined with speech coding parameters of the same type; and inputting the set of combined speech coding parameters into a speech synthesizer.

2. The method of claim 1 wherein determining a weighting metric further comprises dividing the normalized gain value for a given channel by the summation of the normalized gain values for each of the channels over which speech coding parameters were received, thereby determining a weighting metric for the given channel.

3. The method of claim 1 wherein determining a weighting metric further comprises identifying a channel having the largest gain value and assigning a predefined weight to the identified channel.

4. The method of claim 1 wherein weighting the speech coding parameters further comprises multiplying each speech coding parameter of a given type by the corresponding weighting metric and summing the products to form a combined speech coding parameter for the given parameter type.

5. The method of claim 1 further comprises determining a weighting metric on a frame-by-frame basis.

6. The method of claim 1 wherein the voice data encoded in the data streams is encoded in accordance with mixed excitation linear prediction (MELP), such that speech coding parameters include gain, pitch, unvoiced flag, jitter, bandpass voicing and a line spectral frequency (LSF) vector.

7. The method of claim 1 wherein the voice data encoded in the data streams is encoded in accordance with linear predictive coding or continuously variable slope delta modulation (CVSD).

8. The method of claim 1 wherein the parametric model is further defined as a source-filter model.

9. A method for decoding data streams in a full-duplex voice communication system, comprising:

receiving multiple sets of speech coding parameters, where each set of speech coding parameters was received over a different channel in the system;

determining a weighting metric for each channel over which speech coding parameters were received;

weighting the speech coding parameters using the weighting metric for the channel over which the parameters were received;

summing weighted speech coding parameters to form a set of combined speech coding parameters; and outputting the set of combined speech coding parameters to a speech synthesizer.

10. The method of claim 9 further comprises receiving two or more data streams having voice data encoded therein at a receiver, where each data stream corresponds to a channel in the system, and decoding each data stream into a set of speech coding parameters.

11. The method of claim 10 wherein the voice data encoded in the data streams is encoded in accordance with mixed excitation linear prediction (MELP), such that speech coding parameters include gain, pitch, unvoiced flag, jitter, bandpass voicing and a line spectral frequency (LSF) vector.

12. The method of claim 10 wherein the voice data encoded in the data streams is encoded in accordance with linear predictive coding or continuously variable slope delta modulation (CVSD).

13. The method of claim 9 wherein the weighting metric is derived from a gain at which a given data stream was received at.

14. The method of claim 9 wherein determining a weighting metric further comprises normalizing a gain value for each channel;

converting the normalized gain values to linear gain values; and dividing the normalized linear gain value for a given channel by the summation of the normalized linear gain values for each of the channel over which speech coding parameters were received, thereby determining a weighting metric for the given channel.

15. The method of claim 9 wherein weighting the speech coding parameters further comprises multiplying each speech coding parameter of a given type by the corresponding weighting metric and summing the products to form a combined speech coding parameter for the given parameter type.

16. A vocoder for a voice communication system, comprising:

a plurality of decoding modules, each decoding module adapted to receive an incoming data stream over a different channel and decode the incoming data stream to a set of speech coding parameters, where the speech coding parameters were derived from a parametric model of a vocal tract;

a combining module adapted to receive the set of speech coding parameters from each of the decoding modules and operable to determine a weighting metric for each channel over which speech coding parameters were received and normalize the weighting metric for each channel to a linear scale, where the weighting metric is derived from an energy value at which a given data stream was received, the combining module further operable to weight the speech coding parameters using the weighting metric for the channel over which the parameters were received and combine the weighted speech coding parameters to form a set of combined speech coding parameters, where speech coding parameters of a given type are combined with speech coding parameters of the same type; and a speech synthesizer adapted to receive the set of combined speech coding parameters and generate audible speech therefrom.

* * * * *